US009829214B2

(12) United States Patent
Taylor

(10) Patent No.: US 9,829,214 B2
(45) Date of Patent: Nov. 28, 2017

(54) CYLINDRICAL TUBULAR HEAT EXCHANGER TYPE 1

(71) Applicant: Ronald Paul Taylor, Pelican Lake, WI (US)

(72) Inventor: Ronald Paul Taylor, Pelican Lake, WI (US)

( * ) Notice: Subject to any disclaimer, the term of this patent is extended or adjusted under 35 U.S.C. 154(b) by 286 days.

(21) Appl. No.: 14/692,742

(22) Filed: Apr. 22, 2015

(65) Prior Publication Data

US 2016/0313074 A1 Oct. 27, 2016

(51) Int. Cl.

| | |
|---|---|
| ***F28D 1/06*** | (2006.01) |
| ***F24H 3/00*** | (2006.01) |
| ***F28F 9/02*** | (2006.01) |
| ***F28D 7/16*** | (2006.01) |
| *F28D 21/00* | (2006.01) |

(52) U.S. Cl.

CPC ..... *F24H 3/00* (2013.01); *F28D 7/1669* (2013.01); *F28F 9/02* (2013.01); *F28D 2021/0024* (2013.01)

(58) Field of Classification Search

CPC ..... F24H 3/00

USPC ..... 165/75, 141; 29/890.03, 890.045

See application file for complete search history.

(56) References Cited

U.S. PATENT DOCUMENTS

| | | | | |
|---|---|---|---|---|
| 3,339,260 | A * | 9/1967 | Burne | B21D 53/06 165/154 |
| 4,098,329 | A * | 7/1978 | Culver | F28D 7/1669 122/32 |
| 4,221,262 | A * | 9/1980 | Baumgaertner | F28D 7/1669 122/32 |
| 5,161,605 | A * | 11/1992 | Gutlhuber | B01J 8/067 165/103 |
| 2003/0102116 | A1* | 6/2003 | Memory | F28D 1/05366 165/173 |
| 2006/0187751 | A1* | 8/2006 | Lepine | F28C 3/04 366/336 |
| 2013/0224104 | A1* | 8/2013 | Naterer | C01B 3/08 423/648.1 |

* cited by examiner

*Primary Examiner* — Nina Bhat

(74) *Attorney, Agent, or Firm* — Garrett James O'Sullivan; Eric Brandon Lovell; Timothy Marc Shropshire

(57) ABSTRACT

A tubular heat exchanger employing radially arranged heat exchange tubes surrounding and attached to a center tube enclosing a heat source by an annular top flange attached to a removable top cover above the tube arrangement. The heat exchange tubes are connected at the bottom to an exhaust collection manifold which is in turn connected to an exhaust outlet pipe vented to the atmosphere. As heated fluid ascends inside the center tube, it is forced outwardly inside the top cover, apportioning the heated fluid into equally spaced radially arranged heat exchange tubes. The heated fluid descends inside the heat exchange tubes, disbursing heat outwardly through the walls of the heat exchange tubes into the ascending heat transfer fluid. The mostly cooled heated fluid is collected and recombined in the exhaust collection manifold and into the exhaust outlet pipe. The heat transfer fluid ascends above the top cover for final utilization.

9 Claims, 8 Drawing Sheets

CYLINDRICAL TUBULAR HEAT EXCHANGER TYPE 1

FIELD OF THE INVENTION

The present invention relates to heat exchangers and, more particularly, to concentric tubular heat exchangers enclosing an ascending central heat source with a radially arranged downdraft tube configuration around the central tube periphery.

BACKGROUND OF THE INVENTION

This invention relates generally to heat exchangers, more particularly to tubular heat exchangers, and specifically to cylindrical tubular heat exchangers enclosing a central heat source.

In the field of heat exchangers, a need has arisen for a heat exchanger that is easily serviceable to maintain high efficiency throughout the life of the unit. A major drawback of conventional heat exchangers is a lack of internal accessibility due to their rigid welded construction, preventing easy routine maintenance necessary to clean residual combustion byproducts from the internal surfaces of such heat exchangers. Additionally, conventional heat exchangers are generally located remotely from the heat source due to their enclosed configurations, which can cause a loss of heat. Additionally, conventional heat exchangers do not employ well thought out compact designs needed to optimize overall system integrity.

Only in large commercial and industrial heat exchangers and boilers are the internal surfaces somewhat more accessible, primarily due to the physical size of the components, allowing more room to get in and clean.

Most heat exchangers are mechanically formed and welded and are not conducive to internal cleaning of residual combustion byproducts, gradually reducing overall efficiency throughout the life of the unit, which is particularly disadvantageous when used in conjunction with solid and biomass type fuels which generally produce more combustion byproducts than liquid and gaseous fuels.

Conventional heat exchangers generally don't enclose the entire heat source, resulting in greater heat loss.

Conventional heat exchangers generally require more space than the present invention for an equivalent amount of heat exchange.

It is thus a primary object of the present invention to provide a novel tubular heat exchanger.

It is further an object of the present invention to provide such a novel tubular heat exchanger which is of simple construction.

It is further an object of the present invention to provide such a novel tubular heat exchanger which can be quickly and easily internally accessed to facilitate convenient cleaning of the internal surfaces of the heat exchanger.

It is further an object of the present invention to provide such a novel tubular heat exchanger which is small in size, relatively inexpensive, and extremely efficient in its operation.

It is further an object of the present invention to provide such a novel tubular heat exchanger to provide an optimum design which surrounds and can enclose a centrally located heat source.

It is further an object of the present invention to provide such a novel tubular heat exchanger which is easily expanded by the lengthening of it's tubular components to increase the available heat transfer area.

SUMMARY OF THE INVENTION

In accordance with the present invention, there is provided a tubular heat exchanger wherein a center tube is employed to enclose an initially ascending internal heated fluid. This ascending internal heated fluid, typically produced by a combustion heat source, is then radially disbursed as it converges toward the internal surface of the top cover of the heat exchanger assembly. The internal heated fluid is drawn or forced outwardly to the internal extremities of the top cover by the updraft flow of the ascending heated fluid, which forces or draws the internal heated fluid downwardly, apportioning the now descending internal heated fluid into a series of equally spaced radially arranged heat exchange tubes attached by an annular flange to the center tube and the top cover. The heat exchange tubes concentrically surround the center tube and are uniformly spaced outwardly from and parallel to the center tube of the heat exchanger assembly. The heat exchange tubes are attached at the bottom to an exhaust collection manifold to which is attached the exhaust outlet pipe or pipes. The internal heated fluid descends axially inside the heat exchange tubes, gradually disbursing heat outwardly through the walls of the heat exchange tubes. The mostly cooled heated fluid is then collected and recombined below in the exhaust collection manifold which is attached to the exhaust outlet pipe or pipes which are in turn vented into the outside atmosphere.

The heat transfer fluid, most often external air, is forced or drawn into the space surrounding the bottom of the exhaust collection manifold. A certain portion of the heat exchange fluid is forced or drawn into the bottom of the inlet tube which extends through the exhaust manifold assembly surrounding the center tube. This inner portion of the heat exchange fluid and is then forced or drawn through the inlet tube, ascending into the inner space between the center tube and the heat exchange tubes which surround the center tube. As the heat transfer fluid ascends axially in the inner space surrounding the heat exchange tubes, it is gradually heated by the heat transferred from the internal heated fluid inside the heat exchange tubes which is conducted outwardly through the walls of the heat exchange tubes. The heat transfer fluid continues to ascend toward the top flange of the center tube as the heat exchange process continues, being forced or drawn outwardly through the axial gaps between the radially arranged heat exchange tubes.

Additionally, the outer portion of the heat transfer fluid below the exhaust collection manifold is forced or drawn into the area around the outside of the exhaust collection manifold and then into the space above the top of the exhaust collection manifold below the bottom flange portion of the outer heat shield assembly which is connected via spacer lugs to the top of the exhaust collection manifold. This outer portion of the heat exchange fluid then enters into the space around the outsides of the heat exchange tubes between the heat exchange tubes and the cylindrical midsection portion of the outer heat shield. The outer portion of the heat transfer fluid then ascends axially in the space between the heat exchange tubes and the outer heat shield, also being gradually heated by the heat transferred from the heated fluid which is inside the heat exchange tubes being conducted outwardly through the walls of the heat exchange tubes. The heated outer portion of the heat transfer fluid continues ascending inside the outer heat shield assembly towards the top flange of the center tube, recombining with the inner portion of the heat transfer fluid which is being forced outwardly through the axial gaps between the radially arranged heat exchanger tubes. As the recombined heated heat transfer fluid ascends above the top cover of the center tube, it draws additional heat from the top cover transferred from the internal heated fluid inside the center tube below the top cover, through the top of the cover, which heat radiates upwardly and outwardly from the top and sides of the top cover, additionally heating the already heated heat transfer fluid, completing the final heat exchange stage from the internal heated fluid to the external heat exchange fluid. The fully heated heat exchange fluid finally exits from the upper plenum of the heat shield assembly to be utilized in a heating system.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
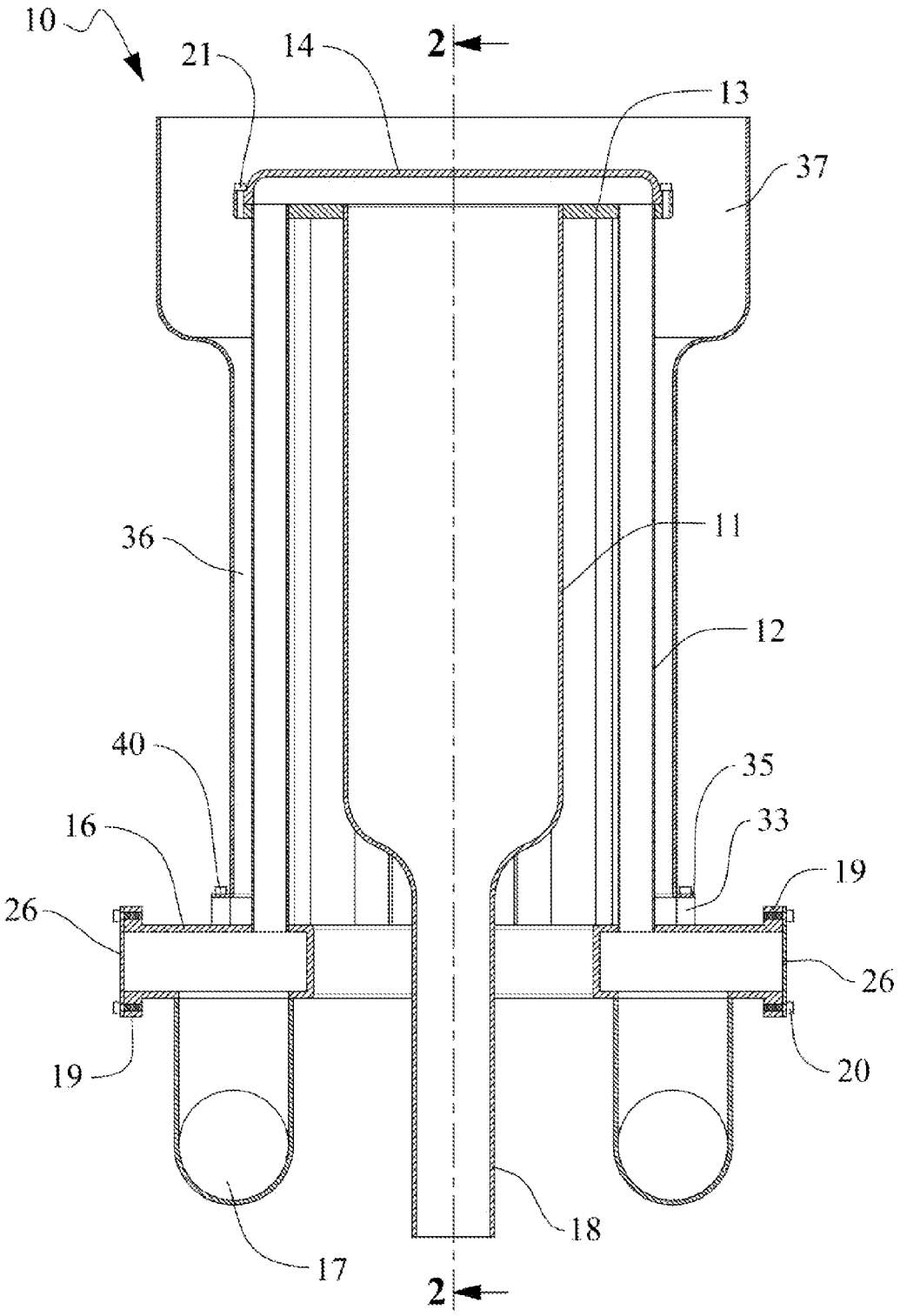
FIG. 1 is a longitudinal cross sectional view of a tubular heat exchanger assembly according to the teachings of the present invention.

In accordance with the teachings of the present invention, there is shown in the drawings a heat exchanger assembly, generally designated 10. Therein is provided a tubular heat exchanger assembly 10 wherein a cylindrical center tube is attached securely in rigid sealing engagement with the top flange 13 of the of the center tube assembly 11. Radially arranged in equally spaced configuration and in press fit side sealing engagement with the top flange 13 of the center tube assembly 11 and the top portion of the exhaust collection manifold assembly 16 are twenty-four heat exchange tubes 12. The exhaust collection manifold assembly 16 is also sealed at both ends by removable end plates 26 bolted securely in sealing engagement to the end flanges 19 of the exhaust collection manifold assembly 16 by a series of spaced screws 20. Also attached in face sealing relation to the top flange 13 of the center tube assembly 11 by a series of radially spaced screws 21 is the removable top cover 14 of the center tube assembly 11. In the preferred form, the tubular heat exchanger assembly 10 employs twenty-four heat exchange tubes 12. The previously mentioned components basically comprise what shall hereinafter be referred to as the heat exchanger core elements. These heat exchanger core elements are surrounded by the outer heat shield assembly 34 consisting of the lower flange region 35, cylindrical midsection 36, and the upper plenum region 37. This outer heat shield assembly 34 attaches by the lower flange region 35 thereof to the top of the exhaust collection manifold assembly 16 via four spacer lugs 33, fastened by a group of four screws.

The basic embodiment of the heat exchanger core assembly provides for a continuous internal flow passage for an internal heated fluid from originating from a heat source either within or entering into the bottom of the center tube assembly 11 via the inlet pipe portion thereof, ascending axially inside the center tube assembly 11 towards and into the internal space within the removable top cover 14, therein apportioned into the radially arranged heat exchange tubes 12. The internal heated fluid then descends axially inside of the heat exchange tubes 12 which flow into the exhaust collection manifold assembly 16 and from there into the exhaust outlet pipe 17 or pipes and finally venting into the atmosphere. This internal fluid flow path is sealed from the external areas around these core elements allowing only the heat to be transferred by conduction through the walls of the components, particularly the heat exchange tubes 12, into the externally flowing heat transfer fluid, which basically flows around the outsides of the heat exchanger core components in a flow direction opposite of the internal flow of the internal heated fluid. This heat transfer fluid is generally external air forced or drawn by mechanical means such as a fan or by convection draft. As previously stated, the external heat transfer fluid basically flows in a direction opposite from the flow direction of the internal heated fluid, which is considered the preferred flow relationship for optimum heat transfer.

Thus the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the present description as well as by the appended claims, and all changes which come within the meaning and range of equivalency of the claims are intended to be embraced therein.

The center tube assembly 11 is employed to enclose an ascending internal heated fluid from either an internal or external heat source. The heated fluid ascends inside the aforementioned center tube assembly 11, being forced or drawn upwardly by either mechanical means, such as fan, or by convection draft. The ascending internal heated fluid is then radially disbursed as it converges towards the space inside the internal surfaces of the removable top cover 14 of the tubular heat exchanger assembly 10 above the top flange 13 of the center tube assembly 11. The heated fluid is then forced or drawn outwardly into the internal extremities of the removable top cover 14 by the updraft flow of the internal heated fluid, which thereby forces or draws the heated fluid downwardly, apportioning the heated fluid into equally spaced radially arranged heat exchange tubes 12 which are in side-sealed engagement with the center tube assembly 11 and the removable top cover 14 by means of the annular top flange 13. The aforementioned heat exchange tubes 12 concentrically axially surround and are radially spaced outwardly from the center tube of the center tube assembly 11 of the heat exchanger assembly and attach at the bottom in side-sealing engagement with the top wall of the exhaust collection manifold assembly 16 adjacent to the inlet tube portion 18 thereof. The internal heated fluid continues to descend inside the heat exchange tubes 12, gradually disbursing heat outwardly through the walls of the heat exchange tubes 12 until the internal heated fluid exits the bottom of the heat exchange tubes 12. The mostly cooled internal heated fluid is then collected and recombined in the exhaust collection manifold assembly 16 which is attached in sealing relation with the exhaust outlet pipe 17 or pipes. The mostly spent heated fluid is finally vented from the exhaust collection manifold assembly 16 into the outer atmosphere via the attached exhaust outlet pipe 17 or pipes.

The heat transfer fluid, most often external air, is forced or drawn either by convection or mechanical means such as fan or other methods of forcing or inducing a draft into the space below and around the exhaust collection manifold assembly 16 and is therein apportioned into the inner and outer portions of the heat transfer fluid. The inner portion of the heat transfer fluid is forced or drawn into the bottom of the inlet tube portion 18 of the exhaust collection manifold assembly 16 and is then forced or drawn upwardly into the space outside of the center tube of the center tube assembly 11 and into the space around the inner outsides of the heat exchange tubes 12, which surround the center tube of the center tube assembly 11, all of which are surrounded by the cylindrical midsection 36 of the outer heat shield assembly 34 which is concentrically radially spaced around the outer outsides of the heat exchange tubes 12. As the inner portion of the heat transfer fluid ascends in the space surrounding the heat exchange tubes 12 between the center tube and the heat exchange tubes 12, it is gradually heated by the heat transferred from the heated fluid inside the heat exchange tubes 12 which is conducted through the walls of the heat exchange tubes 12, as well as by heat that may be conducted through the outer wall of the center tube. As the heat transfer fluid ascends towards the top flange 13 of the center tube assembly 11, it is forced or drawn outwardly from the space between and surrounding the heat exchange tubes 12 through the radially spaced axial gaps between the heat exchange tubes 12. The mostly heated inner portion of the heat exchange fluid is then recollected into the upper plenum region 37 of the outer heat shield assembly 34 which encompasses the top of the heat exchanger adjacent to the removable top cover 14.

Additionally, the outer portion of the heat transfer fluid in the space around and below the exhaust collection manifold assembly 16 is simultaneously forced or drawn around the outside of the exhaust collection manifold assembly 16 above the top of the exhaust collection manifold assembly 16 below the lower flange region 35 of the outer heat shield assembly 34, drawing some of the residual heat from the mostly spent internal heated fluid inside the exhaust collection manifold conducted through the walls of the exhaust collection manifold. This outer portion of the heat transfer fluid is then forced or drawn into the space around the outer outsides of the heat exchanger tubes within the cylindrical midsection 36 of the outer heat shield assembly 34. This outer portion of the heat exchange fluid is also simultaneously gradually heated as it ascends in the space surrounding the heat exchange tubes 12 inside the cylindrical midsection 36 portion of the outer heat shield assembly 34, therein recombining with the heated inner portion of the heat transfer fluid. As the recombined heated heat transfer fluid ascends above the top cover of the center tube assembly 11, it draws additional heat from the top cover transferred from the internal heated fluid inside the center tube assembly 11 below the top cover, conducted through the top wall of the cover, which heat radiates upwardly and outwardly from the top and sides of the top cover adding even more heat to the heated heat transfer fluid, completing the final heat exchange stage from the heated fluid to the heat exchange fluid via the tubular heat exchanger assembly 10. The fully heat diluted heat exchange fluid continues ascending out of the upper plenum region 37 of the outer heat shield assembly 34 above the top cover exiting the top plenum ready to be utilized in a heating system.

It should be appreciated that while the preferred embodiment of the present invention utilizes both an inner portion and an outer portion of the heat exchange fluid to optimize efficiency, that either the inner portion or the outer portion of the heat exchange fluid can facilitate a complete heat exchange system by themselves.

The heat exchanger assembly can utilize either an internal or external heat source for the heated fluid, as explained below.

Figure 2:
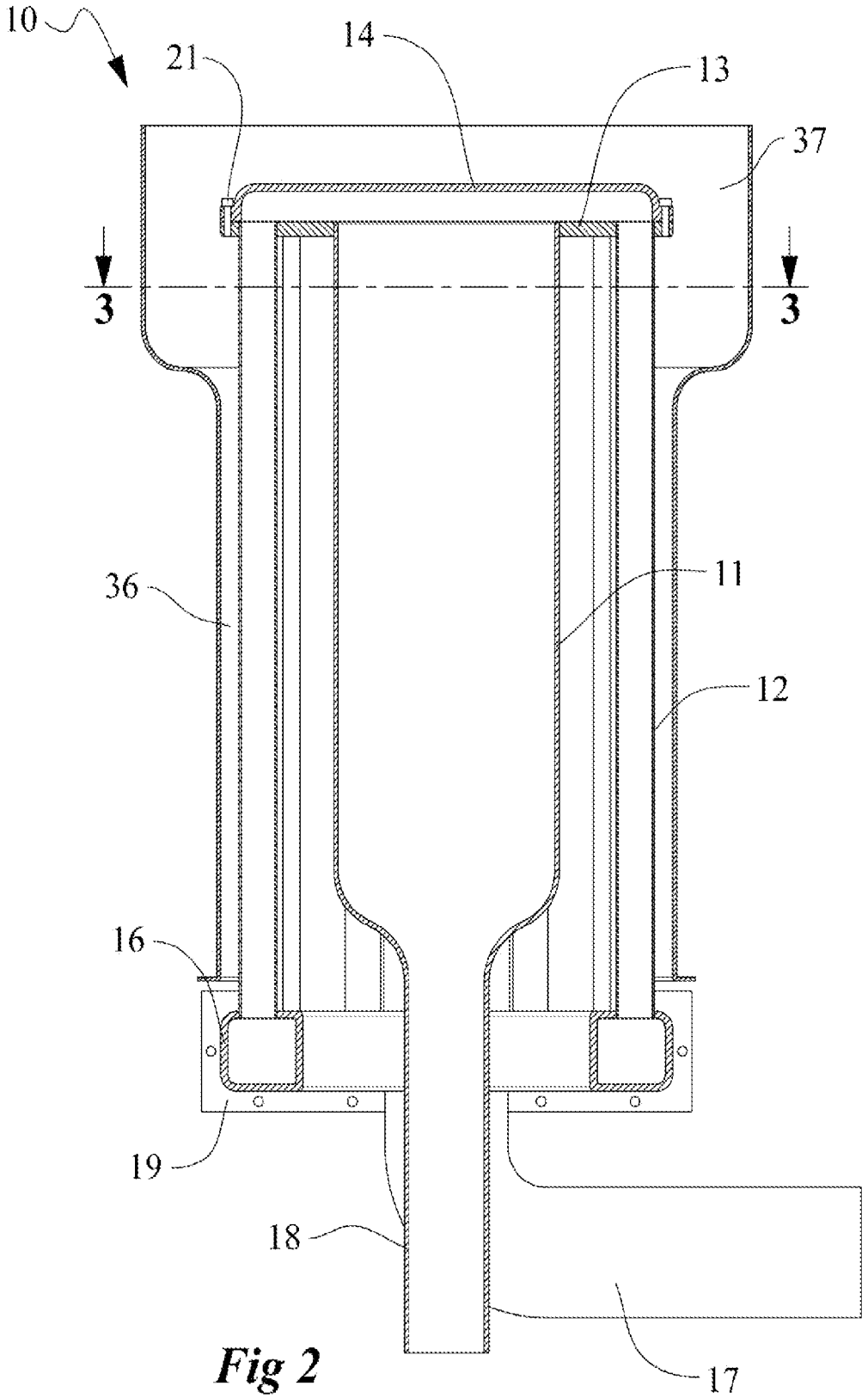
FIG. 2 is a cross sectional view of a heat exchanger assembly of FIG. 1 according to section line 2-2 of FIG. 1.
Figure 3:
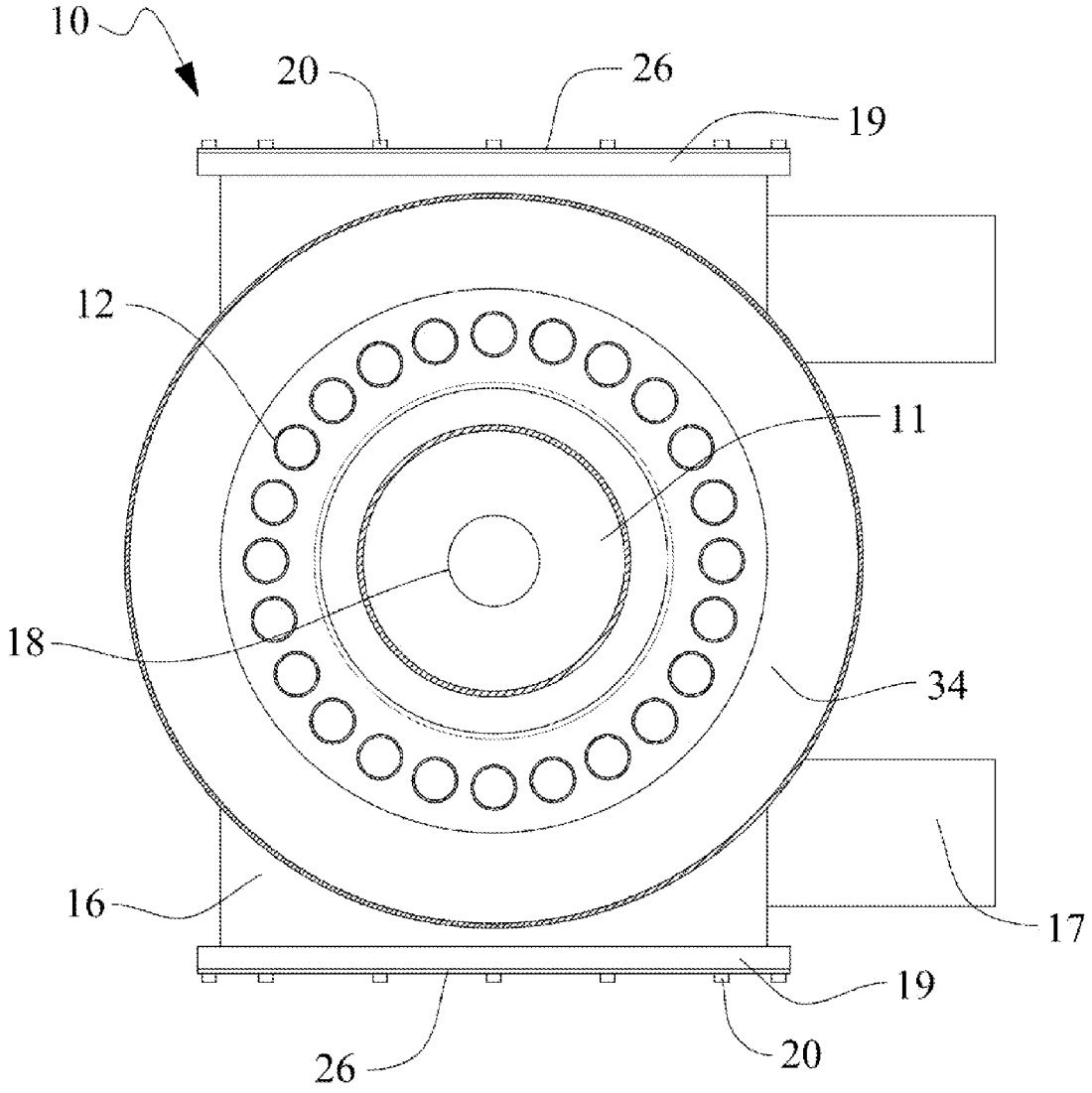
FIG. 3 is a cross sectional view of a heat exchanger assembly of FIG. 1 and FIG. 2 according to 3-3 of FIG. 2.
Figure 4:
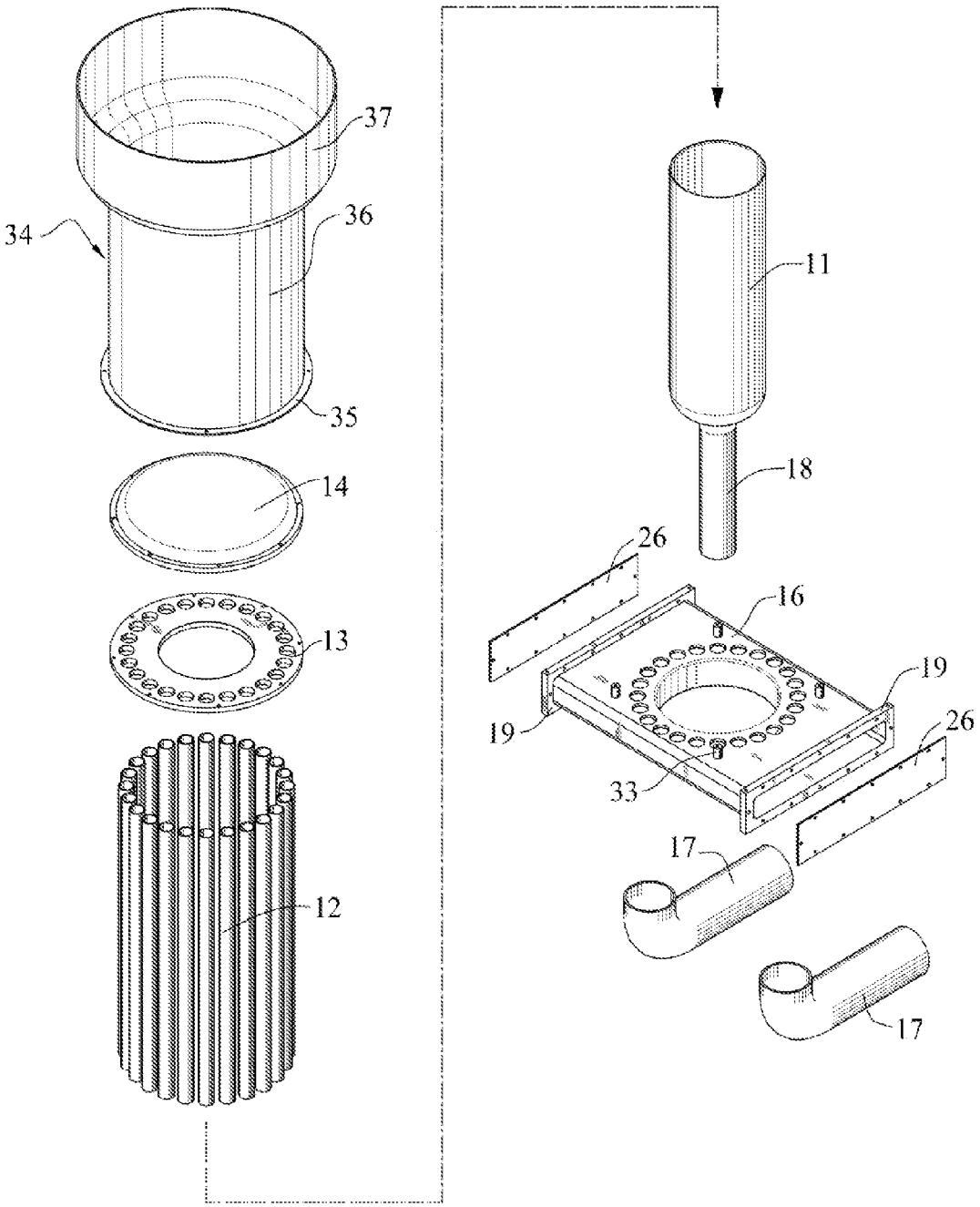
FIG. 4 is an exploded isometric view of an elements depicted in FIG. 1, FIG. 2, and FIG. 3 to enhance the clarity of the relationship of the elements.

Shown in FIGS. 1, 2, 3, 4 is an optional inlet pipe 24 providing for the use of an external combustion source, or possibly a biofuel gasifier, in conjunction with the heat exchanger wherein the space above the inlet pipe of the center tube assembly 11 may be employed as a secondary combustion chamber utilizing inlet air and gasified biofuel forced or drawn in to the aforementioned secondary combustion chamber within the center tube via the inlet pipe, which may or may not require the use of an ignition system in the secondary combustion chamber to initiate the combustion process.

Figure 5:
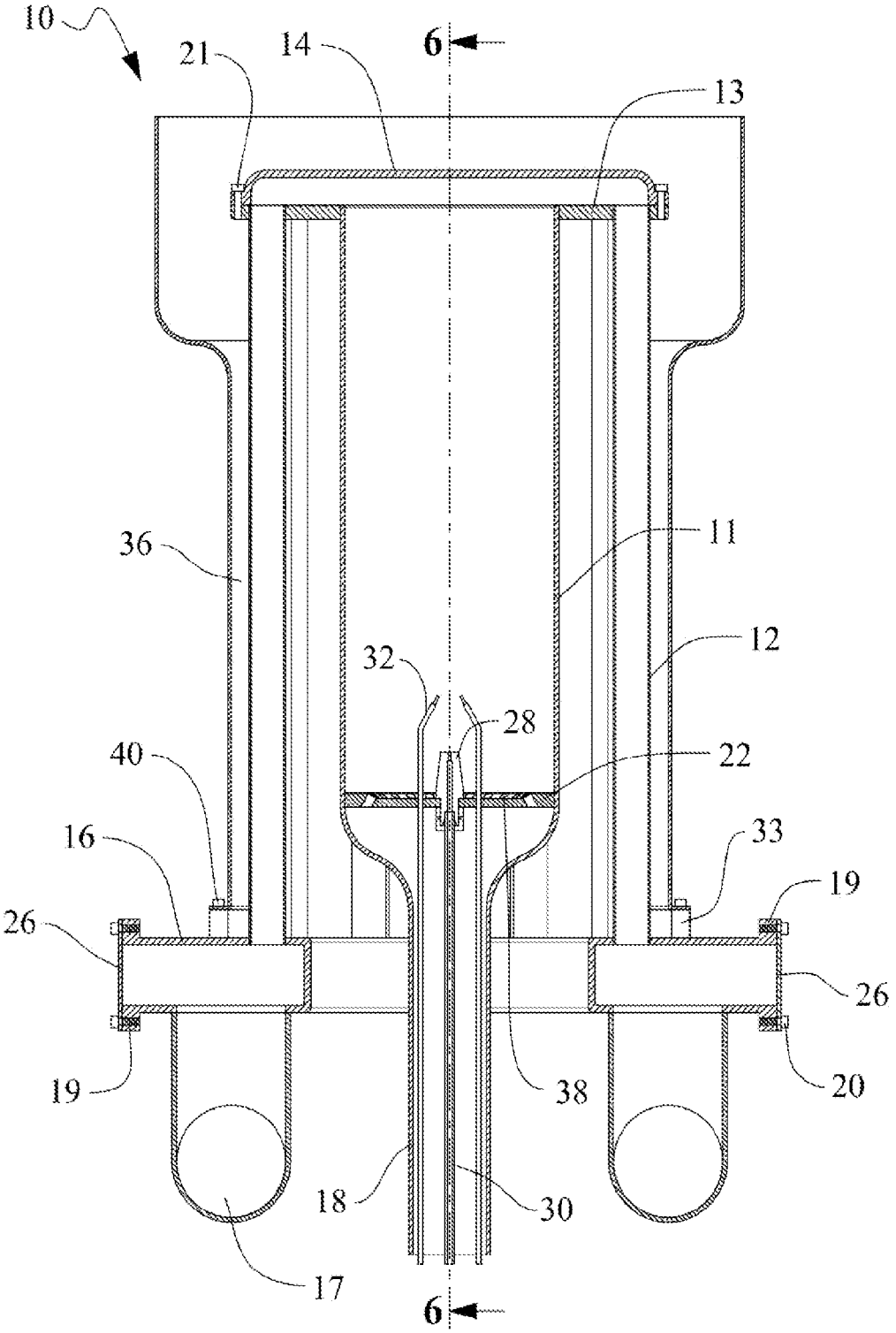
FIG. 5 is a longitudinal cross sectional view of a tubular heat exchanger assembly according to the teachings of the present invention.
Figure 6:
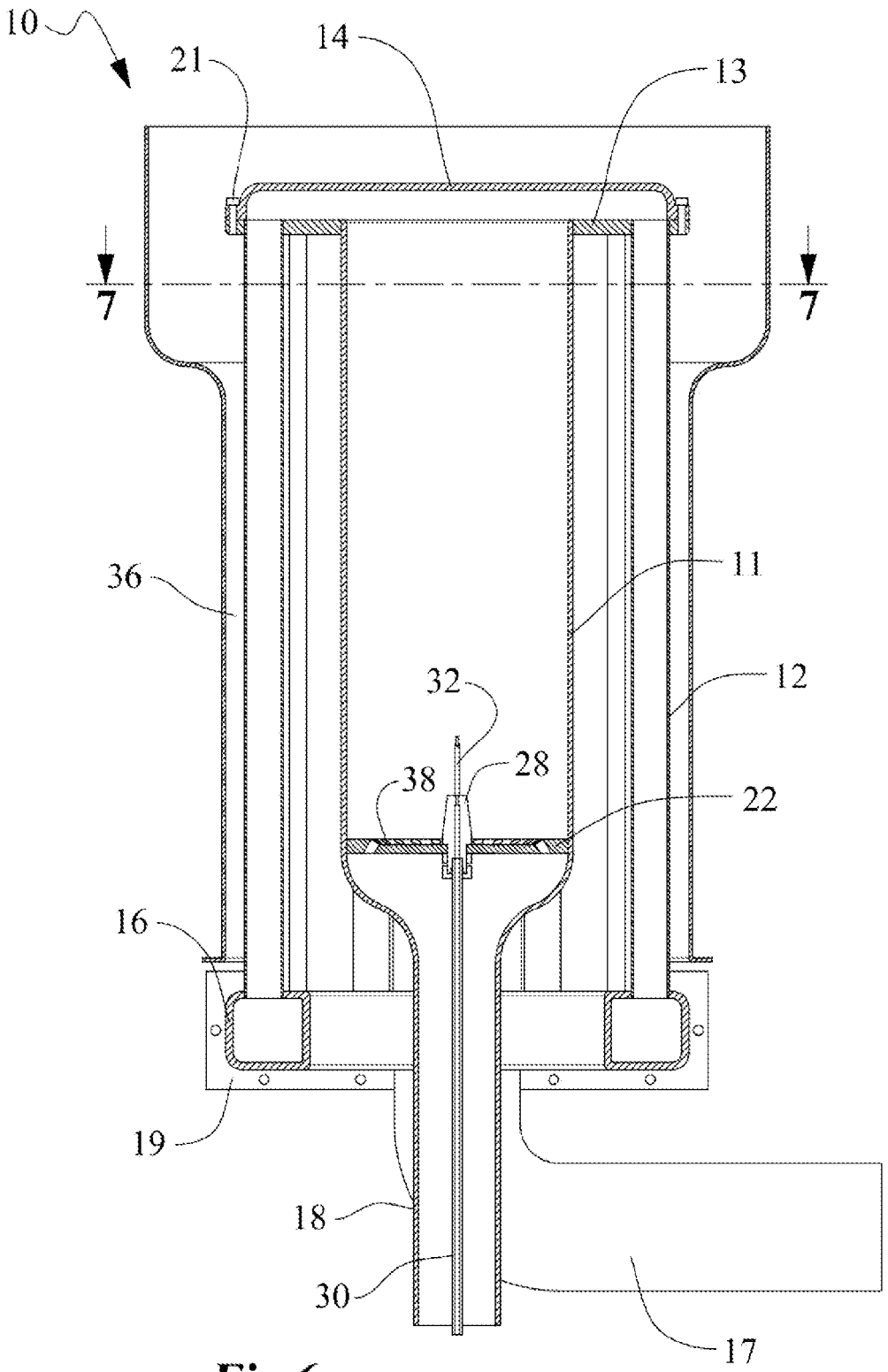
FIG. 6 is a cross sectional view of a heat exchanger assembly of FIG. 5 according to section line 6-6 of FIG. 5.
Figure 7:
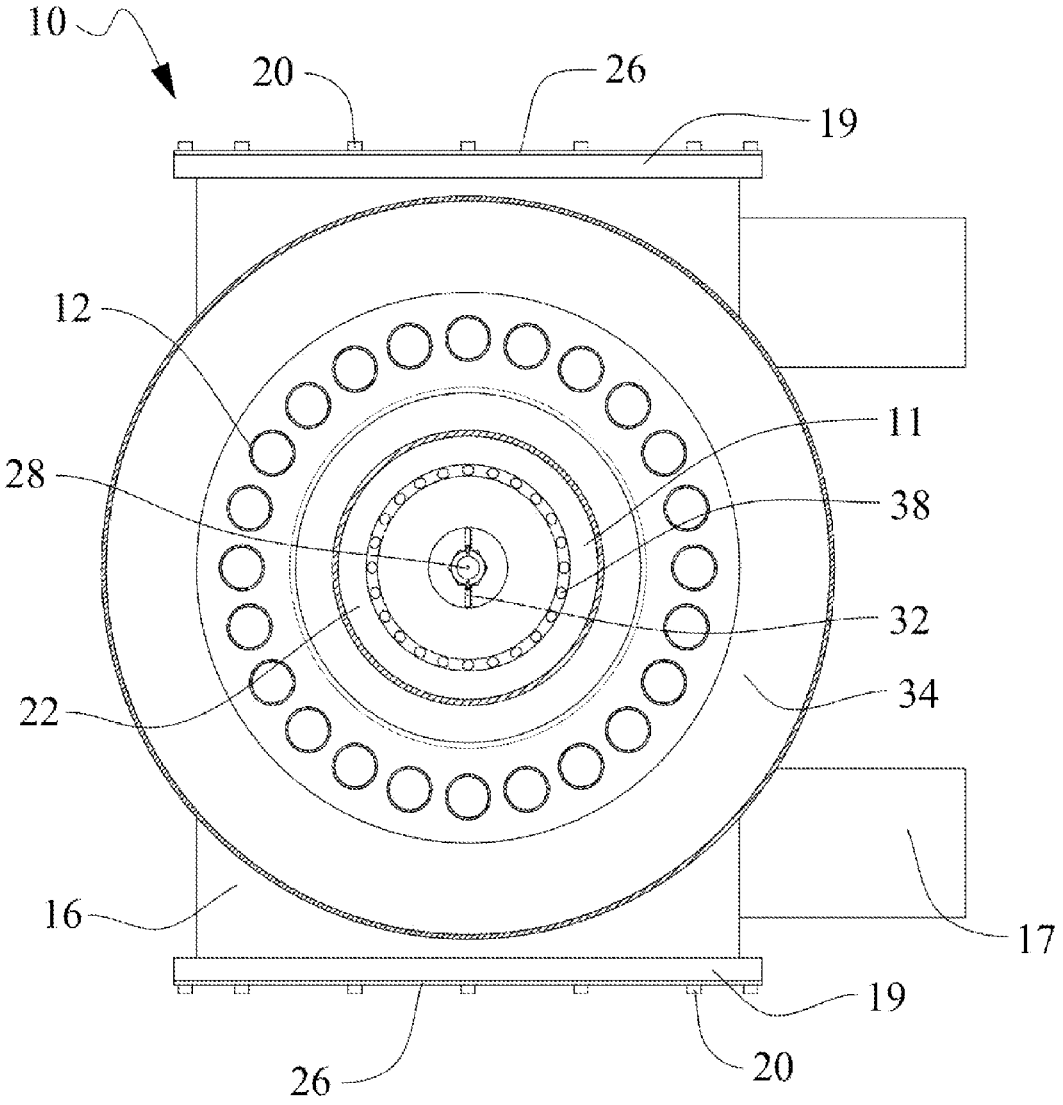
FIG. 7 is a cross sectional view of a heat exchanger assembly of FIG. 5 and FIG. 6 according to 7-7 of FIG. 6.
Figure 8:
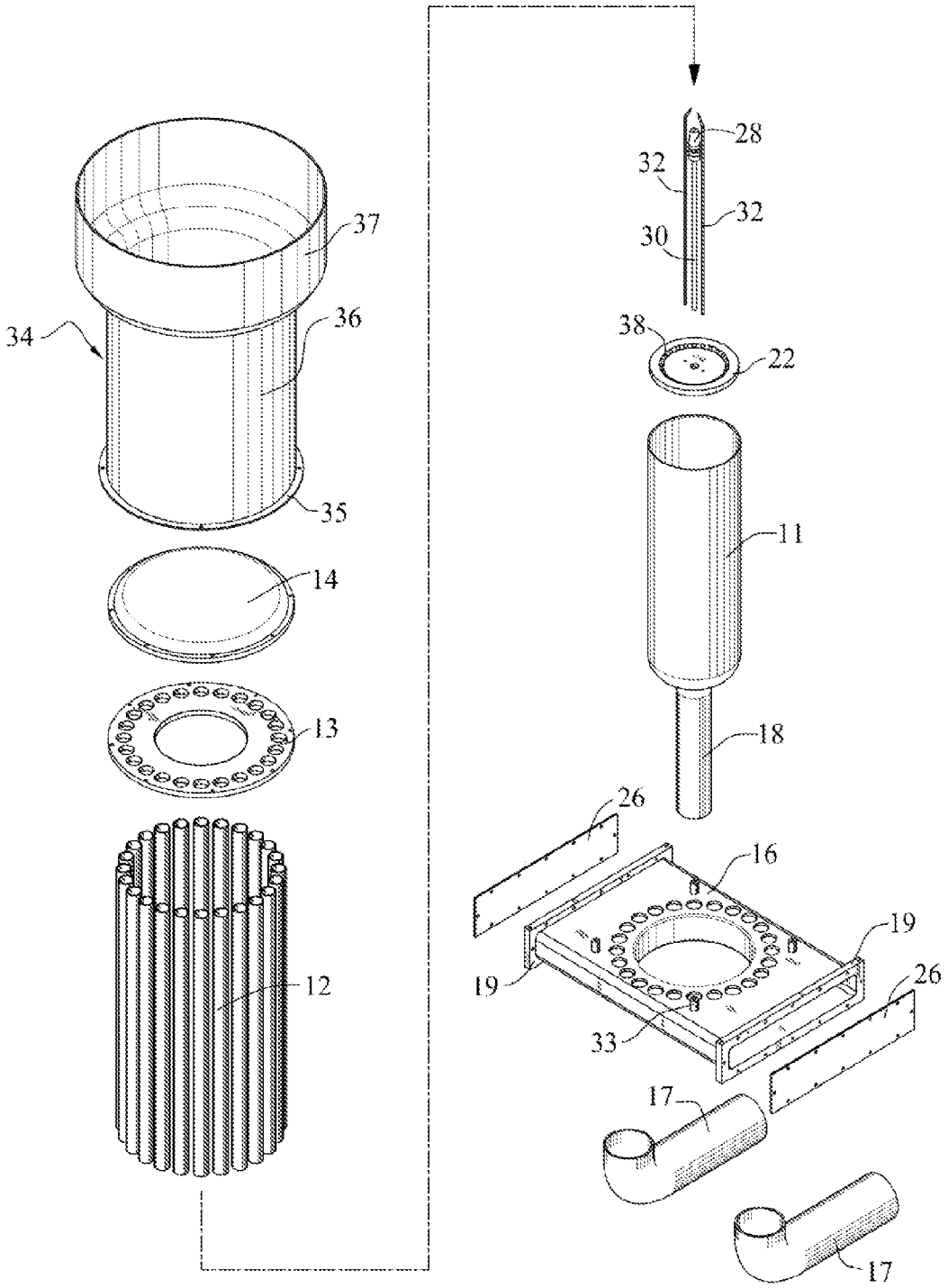
FIG. 8 is an exploded isometric view of an elements depicted in FIG. 5, FIG. 6, and FIG. 7 to enhance the clarity of the relationship of the elements.

Also shown in FIGS. 5, 6, 7, 8 is a typical optional fuel combustion arrangement for the heated fluid source featuring a fuel line 30, fuel nozzle 28, ignition electrodes 32 and combustion air inlet holes 38 extending through the separator plate 22 of the center tube assembly 11 assembly, which, in conjunction with the tubular heat exchanger assembly 10, essentially creates a complete furnace.

The unique design of the present invention provides convenient access to the internal surface areas of the heat exchanger via the removable top cover 14 of the center tube assembly 11 assembly as well as by the removable end plates 26 of the exhaust outlet manifold assembly. This convenient internal accessibility allows for simple cleaning of the internal surfaces of the heat exchanger using brushes and various other types of common utensils to remove built up residual combustion byproducts from the internal surfaces of the tubes and other components of the heat exchanger to maintain maximum heat transfer efficiency throughout the life of the unit.

Another important feature of this cylindrical tubular heat exchanger is the ease of expansion of the heat exchange surface areas by merely increasing the length of the center tube and heat exchange tubes 12.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

In an embodiment, the present invention comprises a cylindrical tubular heat exchanger type 1 for more efficient heat exchange and better serviceability comprising: means for general assembly of the overall tubular heat exchanger; means for encompassing the heat source and combustion area, providing the initial flow conduit for the internal heated fluid ascending from the heat source, as well as helping form a flow path for the inner portion of the heat exchange fluid; means for enclosing a descending internal heated fluid and transferring heat from the internal heated fluid through the outside walls of the heat exchange tubes into the ascending heat transfer fluid surrounding the outside of the heat exchange tubes; means for connecting the top of the center tube with the surrounding heat exchange tubes in sealing engagement, and providing a sealing mounting flange for the removable top cover, tightly fitted to said means for enclosing a descending internal heated fluid and transferring heat from the internal heated fluid through the outside walls of the heat exchange tubes into the ascending heat transfer fluid surrounding the outside of the heat exchange tubes, and rigidly connected to said means for encompassing the heat source and combustion area, providing the initial flow conduit for the internal heated fluid ascending from the heat source, as well as helping form a flow path for the inner portion of the heat exchange fluid; means for providing a sealable cover enclosing the upper flow path of the internal heated fluid and final heat exchange area mounted to the top flange of the center tube assembly to enclose the top of the tubular heat exchanger core assembly and to provide access to the internal surfaces of the heat exchanger core elements when removed, sealably fastened to said means for connecting the top of the center tube with the surrounding heat exchange tubes in sealing engagement, and providing a sealing mounting flange for the removable top cover; means for collecting and recombining the mostly spent internal heated fluid exiting the heat exchange tubes and directing the spent heated fluid into the exhaust outlet pipe or pipes, tightly fitted to said means for enclosing a descending internal heated fluid and transferring heat from the internal heated fluid through the outside walls of the heat exchange tubes into the ascending heat transfer fluid surrounding the outside of the heat exchange tubes; means for providing a passage for the mostly spent heated fluid to exit the exhaust collection manifold, eventually to be exhausted and dispersed into the outside atmosphere, rigidly connected to said means for collecting and recombining the mostly spent internal heated fluid exiting the heat exchange tubes and directing the spent heated fluid into the exhaust outlet pipe or pipes; means for providing both ends of the exhaust collection manifold with a mounting face for the removable end plates, rigidly welded to said means for collecting and recombining the mostly spent internal heated fluid exiting the heat exchange tubes and directing the spent heated fluid into the exhaust outlet pipe or pipes; means for attaching the removable end plates to the end flanges, rigidly fastened to said means for providing both ends of the exhaust collection manifold with a mounting face for the removable end plates; means for attaching the removable top cover to the top flange, rigidly connected to said means for providing a sealable cover enclosing the upper flow path of the internal heated fluid and final heat exchange area mounted to the top flange of the center tube assembly to enclose the top of the tubular heat exchanger core assembly and to provide access to the internal surfaces of the heat exchanger core elements when removed, and rigidly connected to said means for connecting the top of the center tube with the surrounding heat exchange tubes in sealing engagement, and providing a sealing mounting flange for the removable top cover; means for sealing the ends of the exhaust collection manifold and permitting internal access therein when removed, rigidly fastened to said means for attaching the removable end plates to the end flanges, and removably fastened to said means for providing both ends of the exhaust collection manifold with a mounting face for the removable end plates; means for providing a secure mounting location for the outer heat shield assembly spaced above the exhaust collection manifold assembly, integrally connected to said means for collecting and recombining the mostly spent internal heated fluid exiting the heat exchange tubes and directing the spent heated fluid into the exhaust outlet pipe or pipes; means for enclosing the heat exchanger core components, thereby enclosing the ascending heat transfer fluid and minimizing heat loss to the outside, rigidly fastened to said means for providing a secure mounting location for the outer heat shield assembly spaced above the exhaust collection manifold assembly; means for providing an inlet for the outer portion of the heat exchange fluid from around the exhaust collection manifold, and into the cylindrical midsection of the outer heat shield assembly, also providing a mounting link for the outer heat shield assembly, integrally connected to said means for enclosing the heat exchanger core components, thereby enclosing the ascending heat transfer fluid and minimizing heat loss to the outside; means for enclosing the flow path of the ascending heat exchange fluid above the exhaust collection manifold around the core elements of the tubular heat exchanger assembly into the attached upper plenum, integrally connected to said means for providing an inlet for the outer portion of the heat exchange fluid from around the exhaust collection manifold, and into the cylindrical midsection of the outer heat shield assembly, also providing a mounting link for the outer heat shield assembly, and rigidly connected to said means for enclosing the heat exchanger core components, thereby enclosing the ascending heat transfer fluid and minimizing heat loss to the outside; means for providing final mixing and heat dilution of the heat transfer fluid as well as the exit for the heat transfer fluid, rigidly connected to said means for enclosing the flow path of the ascending heat exchange fluid above the exhaust collection manifold around the core elements of the tubular heat exchanger assembly into the attached upper plenum, and rigidly connected to said means for enclosing the heat exchanger core components, thereby enclosing the ascending heat transfer fluid and minimizing heat loss to the outside; means for fastening the lower flange portion of the outer heat shield assembly to the top of the spacer lugs on the exhaust collection manifold, rigidly fastened to said means for enclosing the heat exchanger core components, thereby enclosing the ascending heat transfer fluid and minimizing heat loss to the outside, and rigidly fastened to said means for providing a secure mounting location for the outer heat shield assembly spaced above the exhaust collection manifold assembly; and means for creating an inlet conduit through the middle section of the exhaust collection manifold spaced around the optional inlet pipe of the center tube assembly to provide an entrance for the inner portion of the heat exchange fluid, connected rigidly in sealing engagement with the top and bottom walls of the exhaust collection manifold thereby separating the inlet inner portion of the heat exchange fluid from the mostly spent internal heated fluid within the exhaust collection manifold, integrally connected to said means for encompassing the heat source and combustion area, providing the initial flow conduit for the internal heated fluid ascending from the heat source, as well as helping form a flow path for the inner portion of the heat exchange fluid.

In an embodiment said means for encompassing the heat source and combustion area, providing the initial flow conduit for the internal heated fluid ascending from the heat source, as well as helping form a flow path for the inner portion of the heat exchange fluid comprises an easily internally accessible via top cover, provides mounting for core components center tube assembly.

In an embodiment, in accordance with claim 1, wherein said means for enclosing a descending internal heated fluid and transferring heat from the internal heated fluid through the outside walls of the heat exchange tubes into the ascending heat transfer fluid surrounding the outside of the heat exchange tubes comprises a principle area of heat transfer, easily cleaned of internal residue heat exchange tubes.

In an embodiment, in accordance with claim 1, wherein said means for connecting the top of the center tube with the surrounding heat exchange tubes in sealing engagement, and providing a sealing mounting flange for the removable top cover comprises a connecting link top flange.

In an embodiment, in accordance with claim 1, wherein said means for providing a sealable cover enclosing the upper flow path of the internal heated fluid and final heat exchange area mounted to the top flange of the center tube assembly to enclose the top of the tubular heat exchanger core assembly and to provide access to the internal surfaces of the heat exchanger core elements when removed comprises an aid in serviceability, encloses top of heated fluid flow path removable top cover.

In an embodiment said means for collecting and recombining the mostly spent internal heated fluid exiting the heat exchange tubes and directing the spent heated fluid into the exhaust outlet pipe or pipes comprises an initial heat transfer member, providing the fixed link mounting base exhaust collection manifold assembly.

In an embodiment said means for providing a passage for the mostly spent heated fluid to exit the exhaust collection manifold, eventually to be exhausted and dispersed into the outside atmosphere comprises an exhaust outlet pipe.

In an embodiment said means for providing both ends of the exhaust collection manifold with a mounting face for the removable end plates comprises an aid in sealing ends of exhaust manifold end flanges.

In an embodiment said means for sealing the ends of the exhaust collection manifold and permitting internal access therein when removed comprises an aids in serviceability, due to removable nature removable end plates.

In an embodiment said means for providing a secure mounting location for the outer heat shield assembly spaced above the exhaust collection manifold assembly comprises an airflow passage into the outer heat shield spacer lugs.

In an embodiment said means for enclosing the heat exchanger core components, thereby enclosing the ascending heat transfer fluid and minimizing heat loss to the outside comprises a fluid flow encompassing outer heat shield assembly.

In an embodiment said means for providing an inlet for the outer portion of the heat exchange fluid from around the exhaust collection manifold, and into the cylindrical midsection of the outer heat shield assembly, also providing a mounting link for the outer heat shield assembly, comprises a lower flange region.

In an embodiment said means for creating an inlet conduit through the middle section of the exhaust collection manifold spaced around the optional inlet pipe of the center tube assembly to provide an entrance for the inner portion of the heat exchange fluid, connected rigidly in sealing engagement with the top and bottom walls of the exhaust collection manifold thereby separating the inlet inner portion of the heat exchange fluid from the mostly spent internal heated fluid within the exhaust collection manifold comprises an inlet for the inner portion of the heat exchange fluid inlet tube portion.

In an embodiment for more efficient heat exchange and better serviceability comprising: a more efficient convenient cost effective design tubular heat exchanger assembly, for general assembly of the overall tubular heat exchanger; an easily internally accessible via top cover, provides mounting for core components center tube assembly, for encompassing the heat source and combustion area, providing the initial flow conduit for the internal heated fluid ascending from the heat source, as well as helping form a flow path for the inner portion of the heat exchange fluid; a principle area of heat transfer, easily cleaned of internal residue heat exchange tubes, for enclosing a descending internal heated fluid and transferring heat from the internal heated fluid through the outside walls of the heat exchange tubes into the ascending heat transfer fluid surrounding the outside of the heat exchange tubes; a connecting link top flange, for connecting the top of the center tube with the surrounding heat exchange tubes in sealing engagement, and providing a sealing mounting flange for the removable top cover, tightly fitted to said heat exchange tubes, and rigidly connected to said center tube assembly; an aid in serviceability, encloses top of heated fluid flow path removable top cover, for providing a sealable cover enclosing the upper flow path of the internal heated fluid and final heat exchange area mounted to the top flange of the center tube assembly to enclose the top of the tubular heat exchanger core assembly and to provide access to the internal surfaces of the heat exchanger core elements when removed, sealably fastened to said top flange; an initial heat transfer member, providing the fixed link mounting base exhaust collection manifold assembly, for collecting and recombining the mostly spent internal heated fluid exiting the heat exchange tubes and directing the spent heated fluid into the exhaust outlet pipe or pipes, tightly fitted to said heat exchange tubes; an exhaust outlet pipe, for providing a passage for the mostly spent heated fluid to exit the exhaust collection manifold, eventually to be exhausted and dispersed into the outside atmosphere, rigidly connected to said exhaust collection manifold assembly; an aid in sealing ends of exhaust manifold end flanges, for providing both ends of the exhaust collection manifold with a mounting face for the removable end plates, rigidly welded to said exhaust collection manifold assembly; a spaced screws, for attaching the removable end plates to the end flanges, rigidly fastened to said end flanges; a radially spaced screws, for attaching the removable top cover to the top flange, rigidly connected to said removable top cover, and rigidly connected to said top flange; an aids in serviceability, due to removable nature removable end plates, for sealing the ends of the exhaust collection manifold and permitting internal access therein when removed, rigidly fastened to said spaced screws, and removably fastened to said end flanges; an airflow passage into the outer heat shield spacer lugs, for providing a secure mounting location for the outer heat shield assembly spaced above the exhaust collection manifold assembly, integrally connected to said exhaust collection manifold assembly; a fluid flow encompassing outer heat shield assembly, for enclosing the heat exchanger core components, thereby enclosing the ascending heat transfer fluid and minimizing heat loss to the outside, rigidly fastened to said spacer lugs; a lower flange region, for providing an inlet for the outer portion of the heat exchange fluid from around the exhaust collection manifold, and into the cylindrical midsection of the outer heat shield assembly, also providing a mounting link for the outer heat shield assembly, integrally connected to said outer heat shield assembly; a contains heat transfer fluid, reduces heat loss cylindrical midsection, for enclosing the flow path of the ascending heat exchange fluid above the exhaust collection manifold around the core elements of the tubular heat exchanger assembly into the attached upper plenum, integrally connected to said lower flange region, and rigidly connected to said outer heat shield assembly; a upper plenum region, for providing final mixing and heat dilution of the heat transfer fluid as well as the exit for the heat transfer fluid, rigidly connected to said cylindrical midsection, and rigidly connected to said outer heat shield assembly; a group of four fasteners, for fastening the lower flange portion of the outer heat shield assembly to the top of the spacer lugs on the exhaust collection manifold, rigidly fastened to said outer heat shield assembly, and rigidly fastened to said spacer lugs; and an inlet for the inner portion of the heat exchange fluid inlet tube portion, for creating an inlet conduit through the middle section of the exhaust collection manifold spaced around the optional inlet pipe of the center tube assembly to provide an entrance for the inner portion of the heat exchange fluid, connected rigidly in sealing engagement with the top and bottom walls of the exhaust collection manifold thereby separating the inlet inner portion of the heat exchange fluid from the mostly spent internal heated fluid within the exhaust collection manifold, integrally connected to said center tube assembly.

In an embodiment the present invention further comprises an increasing of the versatility of heat exchanger optional inlet pipe, for allowing the use of an external combustion source or gasifier by providing a fluid flow path into the bottom of the center tube for air and fuel may also be employed to enclose fuel lines and electric wires connected to fuel nozzles and ignition devices utilized in an internal combustion heat source.

Having thus described the invention, what is desired to be protected by Letters Patent is presented in the subsequently appended claims.

I claim:

1. A heat exchange device comprising:

a) a center tube assembly engaged to an exhaust manifold;

b) a plurality of heat exchange tubes surrounding the center tube, wherein each of the plurality of heat exchanger tubes is configured to direct a flow of heated fluid therein;

c) a flange at an upper end of the center tube assembly, wherein the flange is attached to the center tube assembly and each of the plurality of heat exchanger tubes;

d) a cover removably engaged to the flange, wherein a space between the cover and the flange facilitates the flow of heated fluid from the upper end of center tube assembly to each of the plurality of heat exchange tubes; and e) a heat source disposed within the center tube assembly between the exhaust manifold and the upper end.

2. The device of claim 1, wherein the heat source heats a fluid within the center tube assembly.

3. The device of claim 1, wherein the exhaust manifold further comprises one or more removable end plates, wherein the removable end plates allow access to an interior of the exhaust manifold.

4. The device of claim 1, wherein the center tube assembly has a hollow interior from the upper end to an inlet, wherein the exhaust manifold is positioned between the upper end and the inlet, wherein ambient fluid is drawn into the center tube assembly from the inlet.

5. The device of claim 4, wherein the fluid is drawn into the center tube assembly by at least one fan, wherein the at least one fan forces fluid into the center tube assembly, wherein the forced fluid contacts the heat source.

6. The device of claim 5, further comprising a heat shield assembly surrounding the plurality of heat exchanger tubes, wherein the heat shield assembly is attached to the exhaust manifold.

7. The device of claim 6, wherein a plenum portion of the heat shield assembly is opposite the exhaust manifold, wherein the plenum portion facilitates dilution of a secondary heated fluid, wherein the secondary heated fluid is heated through conduction from the plurality of heat changer tubes.

8. The device of claim 1, wherein the over facilitates access to an interior of the central tube assembly.

9. The device of claim 1, further comprising an electrical ignition configured to initiate the heat source, wherein a fuel source is in communication with the heat source within the central tube assembly.

* * * * *